US011725603B1

(12) United States Patent
Uhrich et al.

(10) Patent No.: US 11,725,603 B1
(45) Date of Patent: Aug. 15, 2023

(54) SYSTEMS AND METHODS FOR AIR-FUEL RATIO IMBALANCE MONITOR

(71) Applicant: Ford Global Technologies, LLC, Dearborn, MI (US)

(72) Inventors: Michael Uhrich, Wixom, MI (US); Mario Santillo, Canton, MI (US); Joseph Lyle Thomas, Farmington Hills, MI (US); Stephen William Magner, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/653,729

(22) Filed: Mar. 7, 2022

(51) Int. Cl.

| | |
|---|---|
| ***F02D 41/14*** | (2006.01) |
| ***F01N 13/00*** | (2010.01) |
| ***F02D 41/38*** | (2006.01) |
| ***F01N 11/00*** | (2006.01) |
| ***F01N 9/00*** | (2006.01) |

(52) U.S. Cl.

CPC ..... *F02D 41/1454* (2013.01); *F01N 13/008* (2013.01); *F02D 41/1441* (2013.01); *F02D 41/38* (2013.01); *F01N 9/005* (2013.01); *F01N 11/007* (2013.01); *F01N 2560/02* (2013.01); *F01N 2560/027* (2013.01); *F01N 2560/14* (2013.01); *F01N 2900/04* (2013.01); *F01N 2900/0402* (2013.01); *F01N 2900/0408* (2013.01); *F01N 2900/0411* (2013.01); *F01N 2900/0412* (2013.01); *F01N 2900/0416* (2013.01); *F01N 2900/06* (2013.01); *F01N 2900/1402* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,099,947 | B2 | 1/2012 | Makki et al. | |
| 8,448,421 | B2 | 5/2013 | Bailey et al. | |
| 9,657,663 | B2 | 5/2017 | Santillo et al. | |
| 10,865,721 | B1 * | 12/2020 | Thomas | F02D 41/009 |
| 10,947,910 | B2 | 3/2021 | Magner et al. | |
| 2004/0118109 | A1 * | 6/2004 | Gladden | F01N 3/206 60/285 |
| 2007/0256406 | A1 * | 11/2007 | Makki | F01N 11/007 60/285 |
| 2011/0202230 | A1 * | 8/2011 | Sawada | B01D 53/9409 701/29.2 |
| 2015/0047323 | A1 * | 2/2015 | Beaver | F01N 3/2803 60/299 |
| 2017/0089280 | A1 * | 3/2017 | Santillo | F02D 41/2461 |
| 2017/0350332 | A1 * | 12/2017 | Martin | F02D 41/0087 |
| 2019/0085782 | A1 * | 3/2019 | Brahma | F02D 41/1495 |

* cited by examiner

*Primary Examiner* — Binh Q Tran
(74) *Attorney, Agent, or Firm* — Vincent Mastrogiacomo; McCoy Russell LLP

(57) ABSTRACT

Methods and systems are provided for an exhaust system. In one example, a method may include determining presence of a zone flow based on a comparison of a first exhaust sensor and a second exhaust sensor. The presence or absence of the zone flow may determine a rate at which an air-fuel ratio is adjusted.

17 Claims, 4 Drawing Sheets

SYSTEMS AND METHODS FOR AIR-FUEL RATIO IMBALANCE MONITOR

FIELD

The present description relates generally to controlling an engine to detect air-fuel ratio imbalances.

BACKGROUND/SUMMARY

A vehicle may include an aftertreatment device for treating exhaust gases of an internal combustion engine. Feedback control may be used to control an air-fuel ratio (AFR) of the engine so that engine exhaust constituents may be adjusted to improve aftertreatment device efficiency and meet local regulations. Some vehicles may include a universal exhaust gas oxygen (UEGO) sensor positioned upstream of the aftertreatment device and a heated exhaust gas oxygen (HEGO) sensor positioned downstream of the aftertreatment device to control the AFR near stoichiometry. The UEGO sensor may provide feedback to adjust engine out gases about stoichiometry. The HEGO sensor may provide feedback to bias the engine AFR richer or leaner to improve catalyst efficiency.

An exhaust manifold comprises individual exhaust runners from each engine cylinder that collect into a single tube upstream of the aftertreatment device. To minimize engine-startup emissions, the catalyst may be placed as close to the cylinder exhaust ports as possible to quickly heat the catalyst. Meanwhile, the location of the UEGO sensor is optimized to measure a more homogenous mix of gases from each cylinder, given the limited available space. Since the exhaust tubing space upstream of the catalyst is limited, a typical issue that arises in naturally-aspirated engines is zone flow. Specifically, zone flow is an imbalanced rich/lean flow through the exhaust system resulting from limited space for exhaust gases to mix in a homogenous manner. Zone flow may be more prominent in vehicles free of a turbine. If each cylinder AFR is matched with the AFRs of other cylinders, this zone flow phenomenon is not an issue and stoichiometric AFR can be maintained. However, if there are AFR imbalances from cylinder to cylinder resulting from, say, part-to-part variability or intentionally-induced on-board diagnostics (OBD) imbalances, the exhaust stream will comprise differing levels of AFR depending on the location in the exhaust runner. If the UEGO sensor cannot measure a proper mix of each cylinder's gases due to this zone flow phenomenon, the rich/lean gases may quickly overwhelm the catalyst and exit the tailpipe as increased CO and $NO_x$ emissions.

Some examples of addressing the zone flow phenomenon described above include increasing a number of UEGO sensors, introducing flow mixers to simulate turbine mixing, and increased length sampling tubes for the UEGO and the HEGO sensor to sample a wider cross-section of exhaust gases.

However, the inventors have identified some issues with the approaches described above. For example, increasing the number of UEGO sensors, such as one UEGO sensor per cylinder, increases a manufacturing and a repair cost of the vehicle. Furthermore, a packaging size of the exhaust manifold is increased due to the increased number of sensors. Flow mixers may increase a packaging size while also modifying exhaust gas flow patterns. While the flow mixer may improve exhaust gas homogeneity to the UEGO and HEGO, the flow mixer may increase backpressure during some operating conditions. Additionally, the flow mixer may increase manufacturing costs and complexity. Increasing the size of the sensor sampling tubes may increase manufacturing costs while also increase a packaging size of the sensor. Furthermore, the sampling tube including the increased size may negatively modify exhaust gas flow through the exhaust passage due to backpressure being generated. Additionally, each of the flow mixer and sampling tube may draw heat from exhaust gases, thereby increasing a warm-up period of the aftertreatment device, resulting in a greater number of emissions.

In one example, the issues described above may be addressed by a method including determining a presence of a zone flow in response to a difference between feedback from a first exhaust sensor and a second exhaust sensor. In this way, a rate at which an air-fuel ratio is adjusted may be based on the presence or the absence of the zone flow.

As one example, the first exhaust sensor may be arranged in a catalyst housing between two catalyst bricks and the second exhaust sensor may be arranged outside and downstream of the catalyst housing. If zone flow is absent, then a proportional controller coupled to the first exhaust sensor may be used to adjust an air-fuel ratio. If zone flow is present, then an integral controller coupled to the second exhaust sensor may be used to adjust the air-fuel ratio. By doing this, the air-fuel ratio may be more accurately adjusted during zone flow conditions despite the exhaust system being free of a mixer and a turbine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
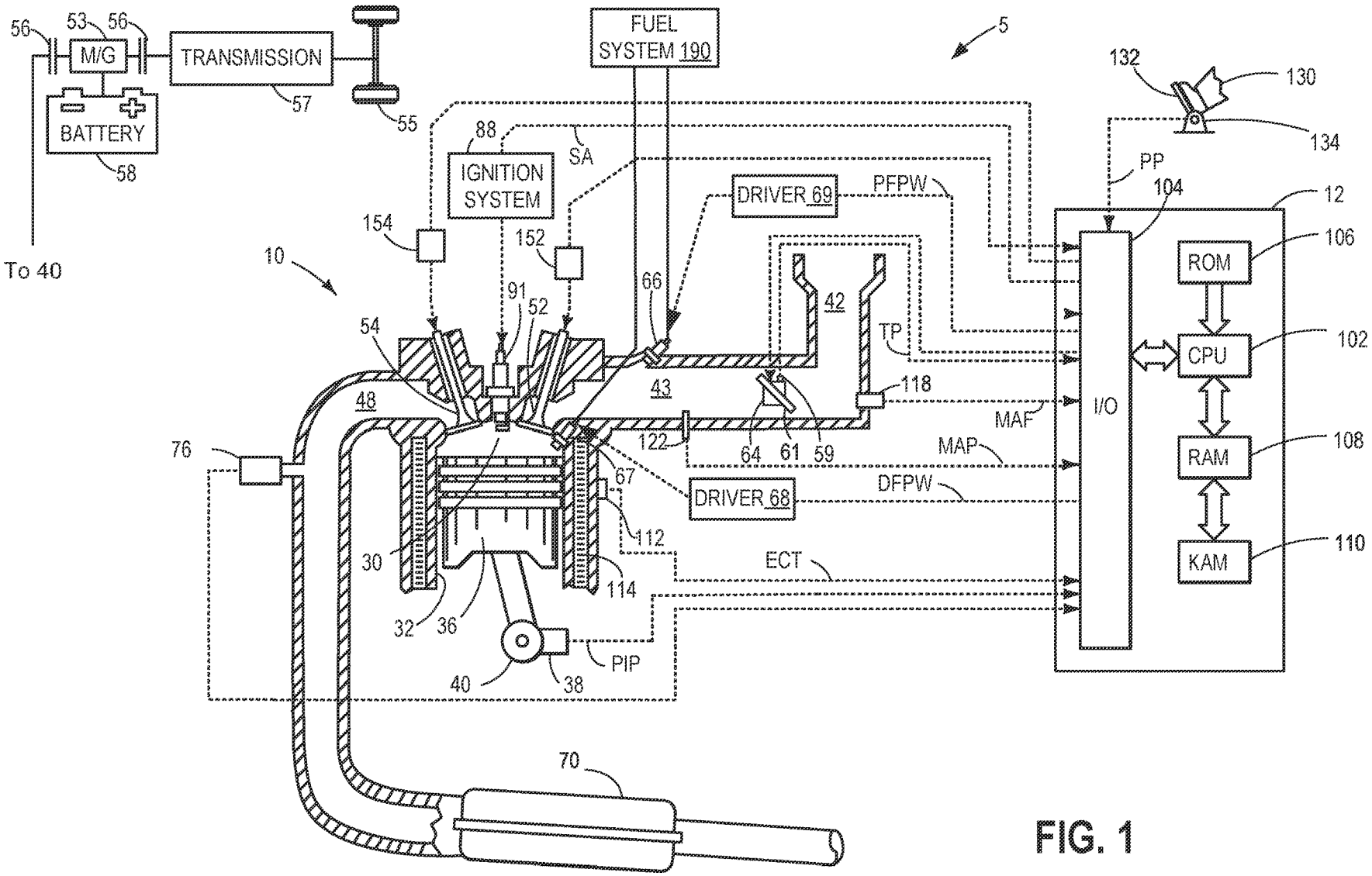
FIG. 1 illustrates a schematic of an engine included in a hybrid vehicle.
Figure 2:
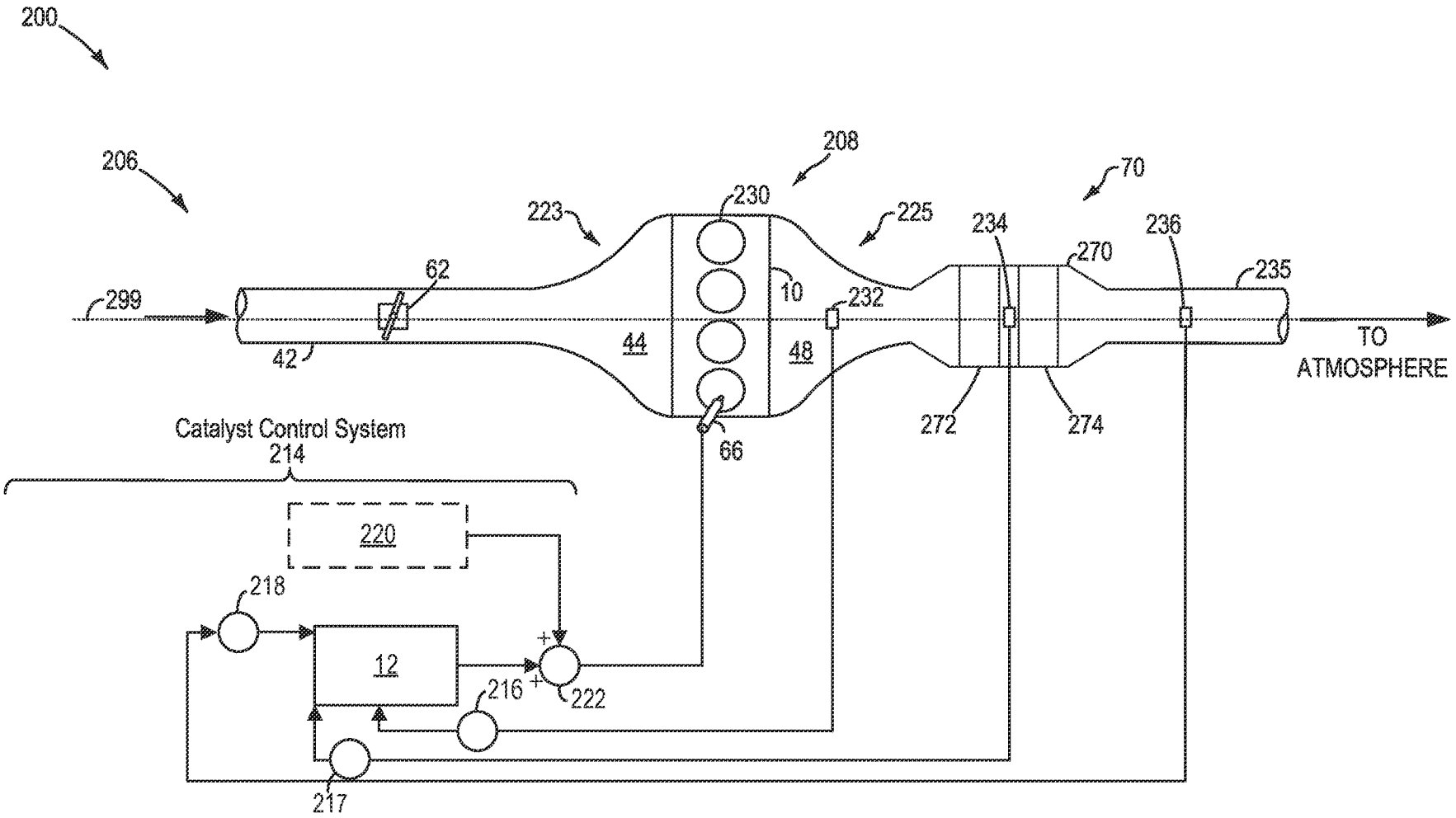
FIG. 2 illustrates a schematic illustration of an example catalyst control system.
Figure 3:
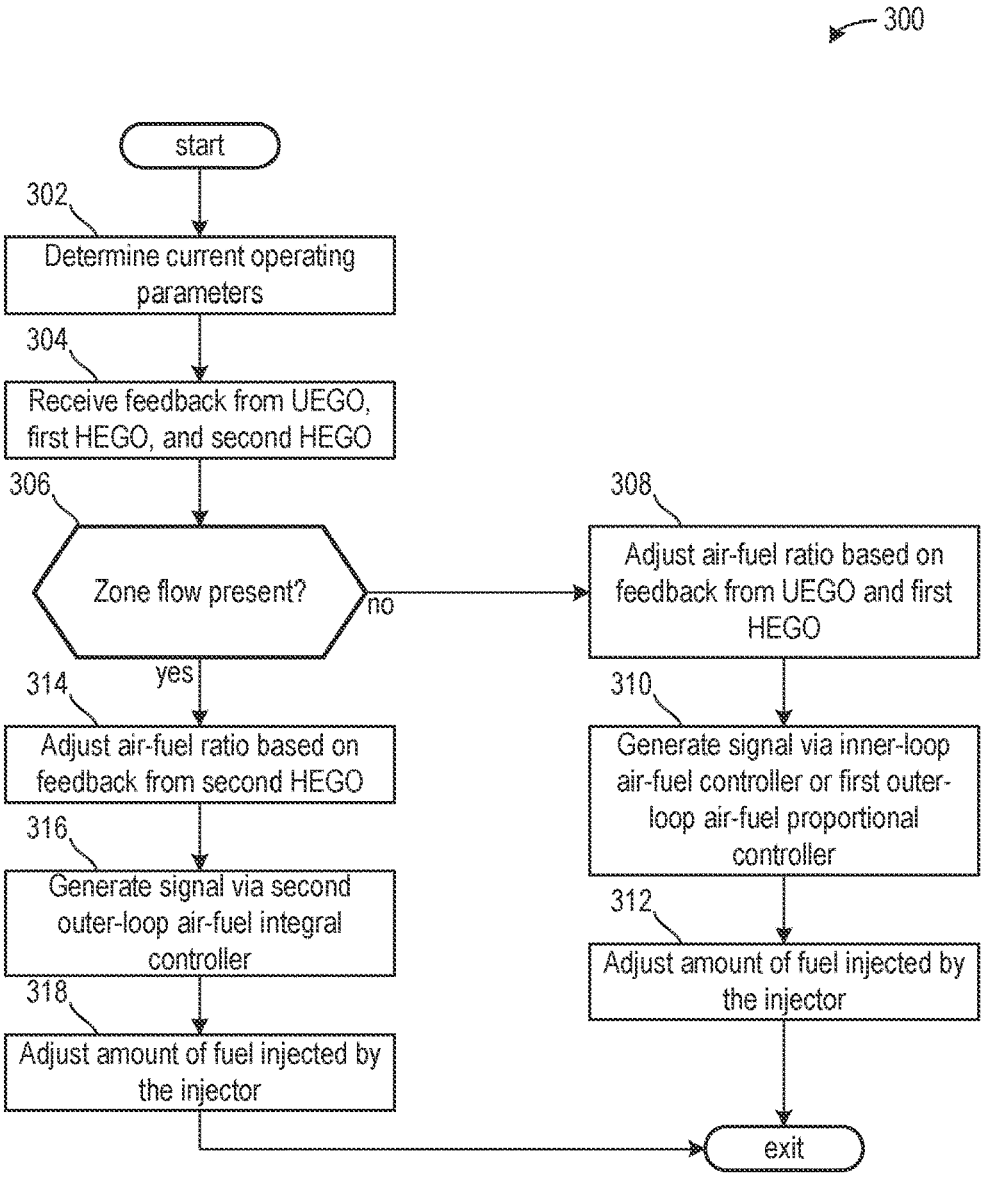
FIG. 3 illustrates a method for adjusting engine operating parameters via the catalyst control system.
Figure 4:
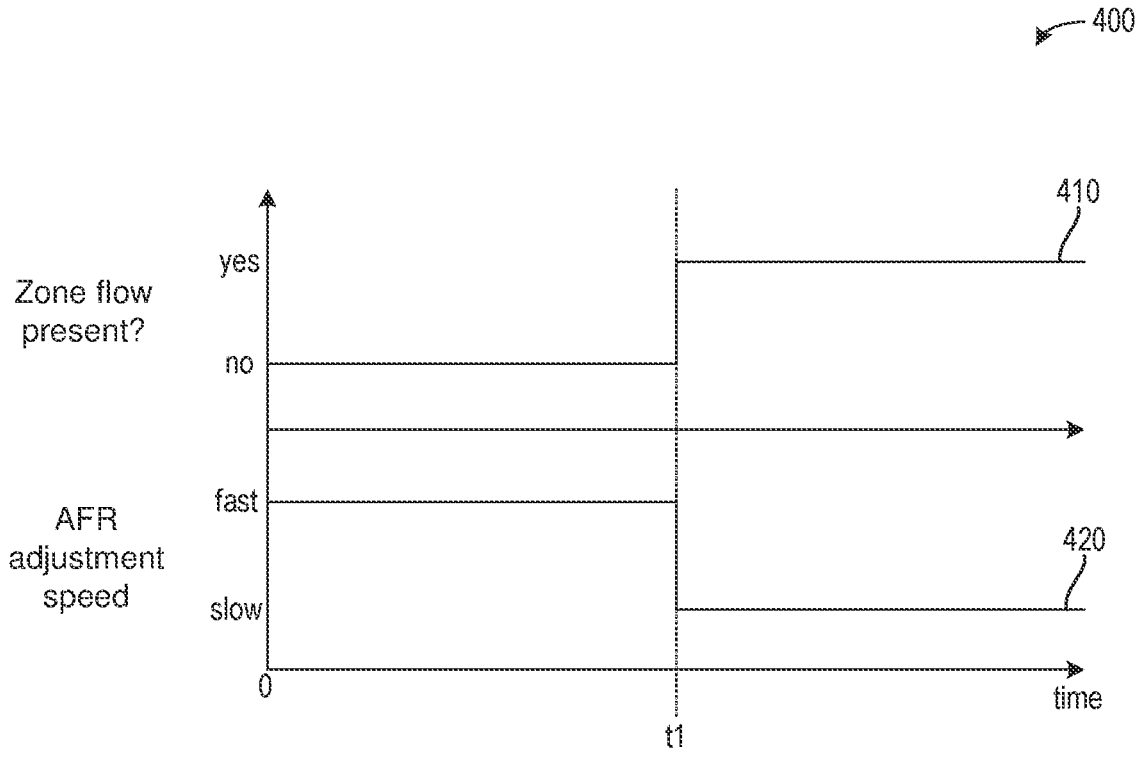
FIG. 4 shows a plot illustrating an engine operating sequence including modifications to an engine fueling in response to feedback from the catalyst control system.

The following description relates to systems and methods for adjusting engine fueling in response to feedback from a plurality of exhaust sensors. The engine may be an engine of a hybrid vehicle as illustrated in FIG. 1. As described above, non-boosted vehicles may experience zone flow phenomenon where exhaust gas flow to exhaust sensors is not representative of an entire exhaust gas mixture due to poor mixing. To overcome issues related to zone flow phenomenon, a catalyst control system may include a UEGO sensor arranged upstream of a catalyst, a first HEGO sensor arranged within a catalyst housing, and a second HEGO sensor arranged downstream of the catalyst housing, as shown in FIG. 2. The sensors may communicate to different controllers or different portions of a controller, wherein feedback from one sensor may be prioritized in response to the presence or absence of zone flow. A method for determining if zone flow is occurring and adjustments to engine operating parameters based on sensor feedback is illustrated in FIG. 3. A plot illustrating an engine operating sequence including modifications to an engine fueling in response to feedback from the catalyst control system is illustrated in FIG. 4.

FIG. 1 shows a schematic depiction of a spark ignition internal combustion engine 10. Engine 10 may be included in a vehicle 5. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 and positioned to directly inject therein in proportion to the pulse width of signal direct fueling pulse-width (DFPW) received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing. In some embodiments, the engine 10 may include only one of the port fuel injector 66 or the direct fuel injector 67.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal port-fueling pulse-width (PFPW) received from controller 12 via electronic driver 69.

Fuel may be delivered to fuel injectors 66 and 67 by a high pressure fuel system 190 including a fuel tank, fuel pumps, and fuel rails. Further, the fuel tank and rails may each have a pressure transducer providing a signal to controller 12. In this example, both direct fuel injector 67 and port fuel injector 66 are shown. However, certain engines may include only one kind of fuel injector such as either direct fuel injector or port fuel injector. Fuel injection to each cylinder may be carried out via direct injectors (in absence of port injectors) or port direct injectors (in absence of direct injectors).

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a universal exhaust gas oxygen (UEGO) sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 40 of engine 10 and electric machine 53 are connected via a transmission 57 to vehicle wheels 55 when one or more clutches 56 are engaged. In the depicted example, a first clutch 56 is provided between crankshaft 40 and electric machine 53, and a second clutch 56 is provided between electric machine 53 and transmission 57. Controller 12 may send a signal to an actuator of each clutch 56 to engage or disengage the clutch, so as to connect or disconnect crankshaft 40 from electric machine 53 and the components connected thereto, and/or connect or disconnect electric machine 53 from transmission 57 and the components connected thereto. Transmission 57 may be a gearbox, a planetary gear system, or another type of transmission. The powertrain may be configured in various manners including as a parallel, a series, or a series-parallel hybrid vehicle.

Electric machine 53 receives electrical power from a traction battery 58 to provide torque to vehicle wheels 55. Electric machine 53 may also be operated as a generator to provide electrical power to charge battery 58, for example during a braking operation.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 59 and an absolute manifold pressure signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 64, fuel injectors 66 and 67, spark plug 91, etc., to adjust engine operation based on the received signals and instructions stored on a memory of the controller. As one example, the controller may send a pulse width signal to the port injector and/or the direct injector to adjust a timing of fuel injection and an amount of fuel delivered to a cylinder via an injector.

FIG. 2 shows a schematic illustration of inner and outer feedback control loops for a catalyst control architecture 200. Catalyst control architecture 200 includes an engine system 208. The engine system 208 may include the engine 10 of FIG. 1. As such, components previously introduced are similarly numbered in this figure. The engine system 208 may be free of both a mixer and a turbine.

The engine 10 includes a plurality of cylinders 230. The engine 10 includes the engine intake 42 and the engine exhaust 48. The engine intake 42 includes the throttle 62 in fluidic communication with engine intake manifold 44. The engine exhaust system 225 includes the exhaust manifold 48 leading to an exhaust passage 235 that routes exhaust gas to the atmosphere. The engine exhaust system 225 may include one or more emission control devices 70, which may be mounted in a close-coupled position in the exhaust. One or more emission control devices may include a three-way catalyst (TWC), lean NOx trap, particulate filter, oxidation catalyst, etc. It will be appreciated that other components may be included in the engine such as a variety of valves and sensors, as depicted, for example, in FIG. 1.

The vehicle system 206 may further include a catalyst control system 214 configured to executed an air-fuel ratio imbalance monitor (AFRIM) for determining variances between a current air-fuel ratio and a desired air-fuel ratio. Catalyst control system 214 is shown receiving information from exhaust gas sensors 232, 234, and 236, and sending control signals to fuel injectors 66. As one example, exhaust gas oxygen sensors may include exhaust gas sensor 232 located upstream of the emission control device 70, exhaust gas sensor 234 located within the emission control device 70, and exhaust gas sensor 236 located downstream of the emission control device 70. If multiple emission control devices are arranged in the exhaust passage, then the exhaust gas sensor 236 may be positioned downstream of all the emission control devices. Additionally or alternatively, exhaust gas sensor 236 may be positioned downstream on only the catalyst brick directly downstream of the exhaust gas sensor 234. Other sensors such as pressure, temperature, and composition sensors may be coupled to various locations in the vehicle system 206. The catalyst control system 214 may receive input data from the various sensors, process the input data, and apply the actuators in response to the processed input data based on instructions or code programmed therein corresponding to one or more routines. Controller 12 of catalyst control system 214 may be configured with instructions stored in non-transitory memory that cause catalyst control system 214 to perform control routines via one or more actuators based on information received via one or more sensors. Example control routines are described herein with reference to FIG. 3.

In one example, emission control device 70 is a three-way catalyst, exhaust gas sensor 232 is a UEGO sensor, the exhaust gas sensor 234 is a first HEGO sensor, and the exhaust gas sensor 236 is a second HEGO sensor. Herein, the first HEGO sensor 234 and the second HEGO sensor 236 may be interchangeably referred to as a first exhaust sensor 234 and a second exhaust sensor 236, respectively.

The emission control device 70 may include a first catalyst 272 and a second catalyst 274. In one example, each of the first catalyst 272 and the second catalyst 274 are three-way catalyst bricks. In some embodiments, one or more of the first catalyst 272 and the second catalyst 274 may be a $NO_x$ trap, particulate filter, or other aftertreatment device. The emission control device 70 may include a housing 270. The housing may include an inlet which increases in diameter in a direction of exhaust gas flow toward the first catalyst. The housing 270 may further include an outlet which decreases in diameter in the direction of exhaust gas flow toward the tailpipe. The housing may include a uniform cross-sectional area (e.g., diameter) from an end of the inlet to a beginning of the outlet, the first and second catalysts arranged within the uniform cross-sectional area.

The UEGO sensor 232, the first HEGO sensor 234, and the second HEGO sensor 236 may be located proximally to a central axis 299 of the exhaust passage 235. In some examples, additionally or alternatively, one or more of the UEGO sensor 232, the first HEGO sensor 234, and the second HEGO sensor 236 may be positioned distally to the central axis 299. The UEGO sensor 232 may be arranged in or adjacent to the exhaust manifold 48 upstream of the inlet of the housing 270 of the emission control device 70. The first HEGO sensor 234 may be arranged in a mid-bed region, within the housing 270, between the first catalyst 272 and the second catalyst 274. In one example, the first HEGO sensor 234 is arranged in a gap representing air space between the first catalyst 272 and the second catalyst 274. In some examples, additionally or alternatively, the first HEGO sensor 234 may be integrally arranged in (e.g., embedded in) one of the first catalyst 272 or the second catalyst 274. The second HEGO sensor 236 may be arranged downstream of the outlet of the housing 270. As such, the second HEGO sensor 236 may be arranged outside of the housing 270 such that the only exhaust gas sensor within the housing 270 is the first HEGO sensor 234.

Catalyst control system 214 regulates the AFR to a desired AFR near stoichiometry and fine-tunes this regulation based on the deviation of a HEGO voltage from a pre-determined HEGO-voltage set point. Inner-loop controller 216 and proportional outer-loop controller 217 use the upstream UEGO sensor 232 and the first HEGO sensor 234 for higher-bandwidth feedback control respectively. Integral outer-loop controller 218 uses the second HEGO sensor 236 for lower-bandwidth control. Catalyst control system 214 may be implemented by an engine controller, such as controller 12. Each of the controllers 216, 217, and 218 may generate signals relayed to the controller 12 for adjusting an air-fuel ratio.

UEGO sensor 232 and first HEGO sensor 234 each provide a feedback signal to respective controllers, the UEGO feedback signal proportional to the oxygen content of the feedgas or engine exhaust between the engine 10 and emission control device 70 (e.g., a TWC) and the first HEGO feedback signal proportional to the oxygen content of feedgas or exhaust gas between the first catalyst 272 and the second catalyst 274. Integral outer-loop controller 218 receives a second HEGO feedback signal and generates a desired air-fuel ratio signal.

In one example, the inner-loop controller 216 in combination with the proportional outer-loop controller 217 may be used for adjusting the air-fuel ratio at a first threshold rate. In one example, the first threshold rate is a relatively fast rate, wherein adjustments are reflexive to air-fuel ratio disturbances (e.g., variances from a desired air-fuel ratio). Relatively fast adjustments may be desired in response to evaporative purge, exhaust-gas recirculation (EGR) flow, and fuel-cut off to one or more cylinders. The inner-loop controller 217 may generate air-fuel ratio modifications with desired gains to modify the air-fuel ratio to account for a disturbance that may cause an emission level to exceed a desired emission level.

The integral outer-loop controller 218 may be used for adjustments of the air-fuel ratio at a second threshold rate due to an oxygen storage amount of the second catalyst 274. The second threshold rate may be a relatively slow rate, slower than the first threshold rate. Slower adjustments may be desired when zone flow is present at the UEGO sensor 232 and the first HEGO sensor 234 as determined by low accuracy readings at the UEGO sensor 232 and the first HEGO sensor 234. The slower adjustments may allow AFRIM to include a greater bandwidth for larger AFRIM fault injections to adjust an air-fuel ratio to stoichiometry or other desired air-fuel ratio. In one example, slower adjustments may include where the adjustments include a higher magnitude of fueling adjustments to change the air-fuel ratio. For example, fuel metering at the second threshold rate may include a larger magnitude of fueling changes compared to fuel metering at the first threshold rate. This may be due to a greater number of adjustments being executed at the first threshold rate. The integral outer-loop controller 218 may also provide inputs to the AFRIM to mitigate alpha/beta errors.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 3, it shows a method 300 for determining if zone flow is occurring and adjusting an air-fuel ratio in response to the presence of zone flow. Instructions for carrying out method 300 may be executed by a controller based on instructions stored on a memory of the controller and in conjunction with signals received from sensors of the engine system, such as the sensors described above with reference to FIG. 2. The controller may employ engine actuators of the engine system to adjust engine operation, according to the method described below.

At 302, the method 300 may include determining current operating parameters. Current operating parameters may include throttle position, manifold pressure, engine speed, engine temperature, vehicle speed, EGR flow rate, and air-fuel ratio.

At 304, the method 300 may include receiving feedback from the UEGO, the first HEGO, and the second HEGO. The UEGO may provide feedback proportional to the oxygen content of the feedgas or engine exhaust between the engine and catalyst. The first HEGO may provide feedback proportional to the oxygen content of the feedgas or engine exhaust between the first catalyst and the second catalyst within the housing. The second HEGO may provide feedback proportional to the oxygen content of the feedgas or engine exhaust between the housing and the tailpipe.

At 306, the method 300 may include determining if zone flow is present. Zone flow may be determined to be present based on a comparison between the UEGO sensor, the first HEGO sensor, and the second HEGO sensor. For example, zone flow may be present if a difference in feedback from the UEGO sensor, the first HEGO sensor, and the second HEGO sensor is greater than a threshold difference. The threshold difference may be equal to a positive, non-zero number. If the difference is greater than the threshold difference, then exhaust flow mixing may be insufficient and zone flow may be present. In one example, feedback from the UEGO sensor, the first HEGO sensor, and the second HEGO sensor is normalized to account for differences in location along the exhaust system. Additionally or alternatively, zone flow may be determined based on a difference between only the UEGO sensor and the second HEGO sensor or the first HEGO sensor and the second HEGO sensor. A difference between the UEGO sensor and the first HEGO sensor may not be used to determine a presence or absence of zone flow.

If zone flow is not present and the difference in feedback is less than the threshold difference, then at 308, the method 300 may include adjusting the air-fuel ratio based on feedback from the UEGO and the first HEGO.

At 310, the method 300 may include generating signals via the inner-loop controller and/or the outer-loop proportional controller. The signals may correspond to desired adjustments in fueling to correct the air-fuel ratio.

At 312, the method 300 may include adjusting an amount of fuel injected by the injector. In one example, the controller may signal to the injector to adjust a fueling of a cylinder based on signals generated by the inner-loop controller and the outer-loop proportional controller, the signals based on feedback from the UEGO and the first HEGO. In one example, signals generated by the outer-loop integral controller based on feedback from the second HEGO may be not be used to adjust the air-fuel ratio.

Retuning to 306, if zone flow is present, then feedback from the UEGO and first HEGO sensors may not be reliable. At 314, the method 300 may include adjusting an air-fuel ratio based on feedback from the second HEGO.

At 316, the method 300 may include generating a signal via the outer-loop integral controller. The signal may be based on the feedback from the second HEGO, wherein the signal is sent to the controller.

At 318, the method 300 may include adjusting an amount of fuel injected by the injector. The controller may signal to the injector to adjust the air-fuel ratio based on the signal generated by the outer-loop integral controller, which is based on feedback from only the second HEGO.

Turning now to FIG. 4, it shows a plot 400 illustrating an engine operating sequence showing changes to how an air-fuel ratio is adjusted based on a zone flow being present. Plot 410 illustrates if a zone flow is present and plot 420 illustrates an air-fuel ratio adjustment speed. Time increases from a left side to a right side of the figure.

Prior to t1, the zone flow is not present (plot 410). As described above, a determination of the presence of zone flow may be determined based on a comparison of the feedback from each of the UEGO sensor, the first HEGO sensor, and the second HEGO sensor. The air-fuel ratio adjustment speed may be relatively fast (plot 420). In one example, a relatively fast air-fuel ratio adjustment speed may include where fueling parameters are adjusted in real-time in response to feedback from the UEGO and the first HEGO. In this way, the air-fuel ratio may be adjusted reflexively based on exhaust gas conditions.

At t1, zone flow is present and the air-fuel ratio adjustment speed switches to a relatively slow adjustment speed. After t1, the air-fuel ratio continues to be adjusted relatively slowly. Slowly adjusting the air-fuel ratio may include using an integral term to adjust the air-fuel ratio to stoichiometry. The AFRIM monitor may now include a larger bandwidth relative to during faster air-fuel ratio adjustments such that larger adjustments may be executed.

In one real world example, signals via the proportional controller may include smaller adjustments to an air-fuel ratio. Signals via the integral controller may include larger adjustments to the air-fuel ratio. Smaller adjustments may occur simultaneously with larger adjustments. Over a determined duration of time, the proportional controller may signal a plurality of fueling adjustments and the integral controller may signal one fueling adjustment. Each of the fueling adjustments may bias toward a slightly rich air-fuel ratio. That is to say, the fueling adjustment may include where the commanded fueling may result in an air-fuel ratio slightly below a lambda of 1 (e.g., lambda equal to 0.98). As one non-limiting example, modifications signaled via the proportional controller may occur on a seconds timescale whereas modifications signaled via the integral controller may occur on a minutes timescale. For example, the integral controller may signal a fueling adjustment every three minutes and the proportional controller may signal a fueling adjustment every three seconds. It will be appreciated that other values and timescales may be used without departing from the scope of the present disclosure.

In this way, air-fuel ratio modifications may be enhanced during conditions where zone flow is present. The technical effect of determining the presence of zone flow and modifying a routine in which the air-fuel ratio is adjusted is to improve engine fueling and reduce emissions. By doing this without introducing additional sensors and gas mixers, a manufacturing cost and complexity may also be reduced.

The disclosure provides support for a method including determining presence of a zone flow in response to a difference between feedback from a first exhaust sensor and a second exhaust sensor. A first example of the method further includes adjusting an air-fuel ratio at a first threshold rate based on feedback from only the first exhaust sensor in response to the zone flow being absent. A second example of the method, optionally including the first example, further includes adjusting the air-fuel ratio at the first threshold rate via an outer loop proportional controller. A third example of the method, optionally including one or more of the previous examples, further includes adjusting the air-fuel ratio at a second threshold rate based on feedback from only the second exhaust sensor in response to the zone flow being present, the second threshold rate is slower than the first threshold rate. A fourth example of the method, optionally including one or more of the previous examples, further includes adjusting the air-fuel ratio at the second threshold rate via an outer loop integral controller. A fifth example of the method, optionally including one or more of the previous examples, further includes where the first exhaust sensor is upstream of the second exhaust sensor, the first exhaust sensor is arranged in a gap in a catalyst housing between a first catalyst and a second catalyst. A sixth example of the method, optionally including one or more of the previous examples, further includes where the first exhaust sensor and the second exhaust sensor are heated exhaust gas oxygen sensors.

The disclosure further provides support for an outer loop air-fuel control system including a catalyst housing comprising a first catalyst and a second catalyst, a first exhaust sensor positioned in a mid-bed region in between the first catalyst and the second catalyst, a second exhaust sensor positioned downstream and outside of the catalyst housing, a proportional controller configured to control an air-fuel ratio based on signals received from the first exhaust sensor, and an integral controller configured to control the air-fuel ratio based on signals received from the second exhaust sensor. A first example of the outer loop air-fuel control system includes where the proportional controller controls the air-fuel ratio at a first threshold rate and the integral controller controls the air-fuel ratio at a second threshold rate, the second threshold rate slower than the first threshold rate. A second example of the outer loop air-fuel control system, optionally including the first example, further includes where the catalyst housing comprises an inlet and an outlet, and wherein the first catalyst and second catalyst are arranged between the inlet and the outlet. A third example of the outer loop air-fuel control system, optionally including one or more of the previous examples, further includes where the first exhaust sensor and the second exhaust sensor intersect with a central axis of an exhaust passage. A fourth example of the outer loop air-fuel control system, optionally including one or more of the previous examples, further includes where a cross-section of the catalyst housing is uniform from the first catalyst and the second catalyst. A fifth example of the outer loop air-fuel control system, optionally including one or more of the previous examples, further includes where a controller with computer-readable instructions stored thereon that when executed enable the controller to determine a presence of a zone flow based on a difference between feedback from the first exhaust sensor and the second exhaust sensor, the controller coupled to each of the proportional controller and the integral controller. A sixth example of the outer loop air-fuel control system, optionally including one or more of the previous examples, further includes where the instructions further enable the controller to signal to a fuel injector based on signals generated via only the proportional controller in response to the zone flow being absent. A seventh example of the outer loop air-fuel control system, optionally including one or more of the previous examples, further includes where the instructions further enable the controller to signal to a fuel injector based on signals generated via only the integral controller in response to the zone flow being present.

The disclosure further provides support for a method including determining presence of a zone flow in response to a difference between feedback from a first exhaust sensor and a second exhaust sensor and adjusting an air-fuel ratio at a first threshold rate based on feedback from only the first exhaust sensor in response to the zone flow being absent. A first example of the method further includes adjusting the air-fuel ratio at a second threshold rate based on feedback from only the second exhaust sensor in response to the zone flow being present, the second threshold rate is slower than the first threshold rate. A second example of the method, optionally including the first example, further includes where the first exhaust sensor is coupled to a proportional controller and the second exhaust sensor is coupled to an integral controller. A third example of the method, optionally including one or more of the previous examples, further includes where the first exhaust sensor is upstream of the second exhaust sensor, the first exhaust sensor is arranged in a gap in a catalyst housing between a first catalyst and a second catalyst, where a cross-section of the catalyst housing is uniform from its inlet to its outlet. A fourth example of the method, optionally including one or more of the previous examples, further includes where an exhaust passage in which the first exhaust sensor and the second exhaust sensor are located is free of a turbine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

determining presence of a zone flow in an aftertreatment system coupled to an engine in response to a difference between feedback from a first exhaust sensor and a second exhaust sensor, the first exhaust sensor is upstream of the second exhaust sensor, the first exhaust sensor is arranged in a gap in a catalyst housing between a first catalyst and a second catalyst.

2. The method of claim 1, further comprising adjusting an air-fuel ratio at a first threshold rate based on feedback from only the first exhaust sensor in response to the zone flow being absent.

3. The method of claim 2, further comprising adjusting the air-fuel ratio at the first threshold rate via an outer loop proportional controller.

4. The method of claim 2, further comprising adjusting the air-fuel ratio at a second threshold rate based on feedback from only the second exhaust sensor in response to the zone flow being present, the second threshold rate is slower than the first threshold rate.

5. The method of claim 4, further comprising adjusting the air-fuel ratio at the second threshold rate via an outer loop integral controller.

6. The method of claim 1, wherein the first exhaust sensor and the second exhaust sensor are heated exhaust gas oxygen sensors.

7. An outer loop air-fuel control system, comprising:

a catalyst housing comprising a first catalyst and a second catalyst;

a first exhaust sensor positioned in a mid-bed region in between the first catalyst and the second catalyst;

a second exhaust sensor positioned downstream and outside of the catalyst housing;

a proportional controller configured to control an air-fuel ratio based on signals received from the first exhaust sensor;

an integral controller configured to control the air-fuel ratio based on signals received from the second exhaust sensor; and a controller with computer-readable instructions stored thereon that when executed enable the controller to:

determine a presence of a zone flow based on a difference between feedback from the first exhaust sensor and the second exhaust sensor, the controller coupled to each of the proportional controller and the integral controller; and signal to a fuel injector based on signals generated via only the proportional controller in response to the zone flow being absent.

8. The outer loop air-fuel control system of claim 7, wherein the proportional controller controls the air-fuel ratio at a first threshold rate and the integral controller controls the air-fuel ratio at a second threshold rate, the second threshold rate slower than the first threshold rate.

9. The outer loop air-fuel control system of claim 7, wherein the catalyst housing comprises an inlet and an outlet, and wherein the first catalyst and second catalyst are arranged between the inlet and the outlet.

10. The outer loop air-fuel control system of claim 7, wherein the first exhaust sensor and the second exhaust sensor intersect with a central axis of an exhaust passage.

11. The outer loop air-fuel control system of claim 7, wherein a cross-section of the catalyst housing is uniform from the first catalyst and the second catalyst.

12. The outer loop air-fuel control system of claim 7, wherein the instructions further enable the controller to signal to the fuel injector based on signals generated via only the integral controller in response to the zone flow being present.

13. A method, comprising:

determining presence of a zone flow of an aftertreatment system coupled to an engine in response to a difference between feedback from a first exhaust sensor and a second exhaust sensor, wherein the first exhaust sensor is upstream of the second exhaust sensor, the first exhaust sensor is arranged in a gap in a catalyst housing between a first catalyst and a second catalyst; and adjusting an air-fuel ratio at a first threshold rate based on feedback from only the first exhaust sensor in response to the zone flow being absent.

14. The method of claim 13, further comprising adjusting the air-fuel ratio at a second threshold rate based on feedback from only the second exhaust sensor in response to the zone flow being present, the second threshold rate is slower than the first threshold rate.

15. The method of claim 13, wherein the first exhaust sensor is coupled to a proportional controller and the second exhaust sensor is coupled to an integral controller.

16. The method of claim 13, wherein a cross-section of the catalyst housing is uniform from its inlet to its outlet.

17. The method of claim 13, wherein an exhaust passage in which the first exhaust sensor and the second exhaust sensor are located is free of a turbine.

* * * * *